US005858916A

United States Patent [19]

Kung et al.

[11] Patent Number: 5,858,916

[45] Date of Patent: Jan. 12, 1999

[54] SUBBING LAYER FOR DYE-RECEIVING ELEMENT FOR THERMAL DYE TRANSFER

[75] Inventors: Teh-Ming Kung, Rochester; Kin K. Lum, Webster; Bruce C. Campbell, Rochester, all of N.Y.

[73] Assignee: Eastman Kodak Company, Rochester, N.Y.

[21] Appl. No.: 798,418

[22] Filed: Feb. 7, 1997

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/211, 342, 447, 513, 913, 914; 503/227

[56] References Cited

U.S. PATENT DOCUMENTS

| | | | |
|---|---|---|---|
| 4,965,241 | 10/1990 | Henzel et al. | 503/227 |
| 5,368,995 | 11/1994 | Christian et al. | 430/530 |
| 5,585,326 | 12/1996 | Martin et al. | 503/227 |

FOREIGN PATENT DOCUMENTS

| | | | |
|---|---|---|---|
| 0 678 397 | 10/1995 | European Pat. Off. | 503/227 |
| 94/05506 | 3/1994 | WIPO . | |
| 94/18012 | 8/1994 | WIPO | 503/227 |

*Primary Examiner*—Bruce H. Hess
*Attorney, Agent, or Firm*—Harold E. Cole

[57] ABSTRACT

A dye-receiving element for thermal dye transfer comprising a support having thereon, in order, a subbing layer and a dye image-receiving layer containing a thermally-transferred dye image, wherein the subbing layer contains an iono-conductive material.

20 Claims, No Drawings

SUBBING LAYER FOR DYE-RECEIVING ELEMENT FOR THERMAL DYE TRANSFER

FIELD OF THE INVENTION

This invention relates to a dye-receiving element used in thermal dye transfer processes, and more particularly to a subbing layer for a dye-receiving element.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. Transport through the thermal printer and image quality are very dependent on the charging characteristics of the receiver element. During the printing process, static charges can build up in the imaged area as the donor is separated from the receiver after printing each dye patch. If the printer is equipped with a smooth, curved steel chute for sheet guidance, transport problems can be encountered if the charged receiver sheet (image side against the steel chute) conforms too well to the chute during rewind. The attraction of the charged sheet to the steel chute can cause transport of the sheet to cease and failure will occur. This problem is exaggerated when printing is done at elevated humidities such as 85% RH. In addition to transport failures, the charged area on the sheet can attract dust and dirt during the printing process which can cause image quality problems.

DESCRIPTION OF RELATED ART

U.S. Pat. No. 5,368,995 relates to an electrically-conductive layer containing fine particles of metal antimonate that can be applied to the outermost layer of an imaging element or the side opposite to the imaging layer. There is a problem with this element during printing, however, in that charge generation can actually be worse (higher).

U.S. Pat. No. 5,585,326 relates to the addition of an ionic dye to the subbing layer of a thermal dye transfer receiver. There is a problem with using such a dye, however, in that it is not very effective in reducing charge generation and results in a color change in the receiver.

WO 94/05506 relates to using a metal oxide-containing electro-conductive material in a subbing layer for thermal transfer printing. There is a problem with using such electro-conductive material, however, in that they need to be added at very high levels, on the order of 15 weight %, to the subbing layer to be effective. Further, such a high amount added to the subbing layer may negatively impact the imaging dyes which may migrate there.

It is an object of this invention to provide a thermal dye-transfer receiver with a subbing layer which will reduce charge generation during transport through a thermal printer.

SUMMARY OF THE INVENTION

This and other objects are accomplished in accordance with the invention, which relates to a dye-receiving element for thermal dye transfer comprising a support having thereon, in order, a subbing layer and a dye image-receiving layer containing a thermally-transferred dye image, wherein the subbing layer contains an iono-conductive material.

DESCRIPTION OF THE PREFERRED EMBODIMENTS

In accordance with the invention, the addition of an iono-conductive material in the subbing layer greatly reduces the charge buildup in the imaged area during the printing process. This results in improved transport of the sheet through the printer and reduced dust/dirt pickup during printing, especially at higher humidities. Also, by using the ionic material in the subbing layer rather than in the dye-receiving layer, there is less chance of an unfavorable reaction with the imaging dyes that reside in the dye-receiving layer after printing.

As used herein, an iono-conductive material is one which is conductive in the presence of moisture. For example, in ionic conduction, ions such as Li+ or Mg+2 need water, such as from a high humidity environment, to be mobile and conduct charges. On the other hand, an electro-conductive material, such as a metal oxide, is conductive at all levels of humidity and is not dependent upon moisture to be conductive.

In a preferred embodiment of the invention, the iono-conductive material is an inorganic salt. Such inorganic salts include, for example, monovalent salts such as LiCl, LiI, NaCl, $KNO_3$, RbCl, CsCl, etc.; divalent salts such as $MgCl_2.6H_2O$, $Mg(NO_3)_2.6H_2O$, $Ca(NO_3)_2.4H_2O$, $Zn(NO_3)_2.6H_2O$, etc.; or trivalent salts such as $AlCl_3.6H_2O$, $Al(NO_3)_3.9H_2O$, $Ce(NO_3)_3.6H_2O$, etc.

The inorganic salts can be used in the subbing layer in a concentration of, for example, from about 0.001 $g/m^2$ to about 1 $g/m^2$.

The subbing layer for the dye-receiving layer used in the invention, can be any of those material used in the art. For example, there may be used materials as disclosed in U.S. Pat. Nos. 5,585,326; 4,748,150; 4,965,241; and 5,451,561.

In a preferred embodiment of the invention, the subbing layer employed in the invention comprises a reaction product of a mixture of a) an aminofunctional organo-oxysilane, and b) a hydrophobic organo-oxysilane.

The aminofunctional organo-oxysilane described above is more fully described in U.S. Pat. No. 4,965,241, the disclosure of which is hereby incorporated by reference.

For the purpose of this invention, "organo-oxysilane" is defined as $X_{4-m}Si(OR)_m$, where X and R represent substituted or unsubstituted hydrocarbon substituents and m equals 1, 2 or 3. "Aminofunctional organo-oxysilane" is defined as an organo-oxysilane as set forth above wherein at least one X substituent contains a terminal or internal amine function. Such compounds can be prepared by conventional techniques and are commercially available.

Specific examples of such aminofunctional organo-oxysilanes are $H_2N(CH_2)_3Si(OC_2H_5)_3$ (3-aminopropyl triethoxysilane, commercially available as product 11,339-5 of Aldrich Chem. Co.), $H_2N(CH_2)_2NH(CH_2)_3Si(OCH_3)_3$ (N-(2-aminoethyl)-3-aminopropyl-trimethoxysilane, commercially available as product Z-6020 of Dow Corning Co.), $H_2N(CH_2)_2NH(CH_2)_2NH(CH_2)_3Si(OCH_3)_3$ (trimethoxysilylpropyl-diethylenetriamine, commercially available as product T-2910 of Petrarch Systems, Inc.), Prosil 221® 3-aminopropyl triethoxysilane (PCR Inc.), and Prosil 3128® N-(2-aminoethyl)-3-aminopropyl-trimethoxysilane (PCR Inc.).

In a further preferred embodiment of the invention, the aminofunctional organo-oxysilane used in the invention has the following formula:

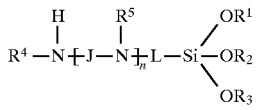

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as $—CH_2—$, $—CH(CH_3)—$, $—C_6H_4—$ or combinations thereof; and n is 0 or a positive integer up to 6.

In a preferred embodiment, J and L are $—C_xH_{2x}$-linking moieties of from 1 to 10 carbon atoms, $R^1$, $R^2$ and $R^3$ are each alkyl groups and n is 0, 1 or 2.

The hydrophobic organo-oxysilanes useful in the invention are formed from a non-substituted alkyl- or aryl-organo-oxysilane. For the purpose of this invention, "hydrophobic organo-oxysilane" is defined as $Y_{4-m}Si(OR)_m$, where Y represents a non-substituted alkyl or aryl group, R represents a substituted or unsubstituted hydrocarbon substituents and m equals 1, 2 or 3. Such silanes can be prepared by conventional techniques and are commercially available. In a preferred embodiment of the invention, the hydrophobic organo-oxysilane also contains an epoxy-terminated organo-oxysilane.

In a further preferred embodiment of the invention, the hydrophobic organo-oxysilane used in the invention has the following formula:

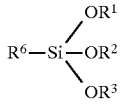

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms; and $R^6$ is a nonsubstituted alkyl group having from about 1 to about 10 carbon atoms, or a nonsubstituted aryl group having from about 5 to about 10 carbon atoms.

Specific examples of such hydrophobic organo-oxysilanes are Prosil 178® isobutyl triethoxysilane (PCR Inc.) and Prosil 9202® N-octyl triethoxysilane (PCR Inc.). Prosil 2210® (PCR Inc.) is an example of an epoxy-terminated organo-oxysilane blended with a hydrophobic organo-oxysilane.

When the two silanes described above are mixed together to form the subbing layer reaction product, it is believed that they will react with each other to form silicon-oxide bonds. It is believed that the reaction product will also form physical bonds with the polymeric dye image-receiving layer and chemical bonds with the polyolefin layer.

The ratios of the two silanes used in the subbing layer may vary widely. For example, good results have been obtained with ratios of from 3:1 to 1:3. In a preferred embodiment, a ratio of 1:1 is used.

The subbing layer of the invention may be employed at any concentration which is effective for the intended purpose. In general, good results have been obtained at a coverage of from about 0.005 to about 0.5 $g/m^2$ of the element, preferably from about 0.05 to about 0.3 $g/m^2$.

The support for the dye image-receiving elements of the invention may be a polymeric, a synthetic paper, or a cellulose fiber paper support, such as a water leaf sheet of wood pulp fibers or alpha pulp fibers, etc., or may comprise a polyolefin monolayer or a polyolefin film laminated to a substrate, such as disclosed in U.S. Pat. No. 5,244,861, the disclosure of which is hereby incorporated by reference. In a preferred embodiment of the invention, a paper substrate having thereon a polyolefin layer such as polypropylene is used. In a further preferred embodiment, a paper substrate having thereon a mixture of polypropylene and polyethylene is used. Such substrates are described more fully in U.S. Pat. No. 4,999,335, the disclosure of which is hereby incorporated by reference. The polyolefin layer on the paper substrate is generally applied at about 10 to about 100 $g/m^2$, preferably about 20 to about 50 $g/m^2$. Synthetic supports having a polyolefin layer may also be used. Preferably, the polyolefin layer of the substrate is subjected to a corona discharge treatment prior to being coated with the subbing layer of the invention.

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Preparation of the Microvoided Support

Receiver support samples were prepared in the following manner. Commercially available packaging films (OPPalyte 350 K18® and BICOR 70 MLT® made by Mobil Chemical Co.) were laminated to the paper stock described below. OPPalyte 350 K18® is a composite film (36 μm thick) (d=0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). BICOR 70 MLT® is an oriented polypropylene film (18 μm thick). Reference is made to U.S. Pat. No. 5,244,861 where details for the production of this laminate are described.

Packaging films may be laminated in a variety of ways (by extrusion, pressure, or other means) to a paper support. In the present context, they were extrusion laminated as described below with pigmented polyolefin on the frontside and clear polyolefin on the backside of the paper stock support. The OPPalyte® 350 K18 film was laminated on the frontside and the BICOR 70 MLT® film was laminated on the backside. The pigmented polyolefin (12 g/m$^2$) contained anatase titanium dioxide (12.5% by weight) and a benzoxazole optical brightener (0.05% by weight). The clear polyolefin was high density polyethylene (12 g/m2).

The paper stock was 137 μm thick and made from a 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite of 0.69 μm average fiber length), available from Weyerhauser Paper Co.

Preparation of Control Dye-Receiver Elements (C-1)

A subbing layer (SL) coating solution was prepared by mixing 3-aminopropyl triethoxysilane, Prosil 221®, (PCR Inc.) (0.055 g/m$^2$) with a hydrophobic epoxy-terminated organo-oxysilane, Prosil 2210®, (PCR Inc.) (0.055 g/m$^2$) in an ethanol-methanol-water solvent mixture. This solution contained approximately 1% of silane component, 1% water and 98% of 3A alcohol.

The test solutions were coated onto the above receiver support. Prior to coating, the support was subjected to a corona discharge treatment of approximately 450 joules/m$^2$.

Each subbing layer test sample was overcoated with a dye-receiving layer (DRL) containing Makrolon KL3-1013® polyether-modified bisphenol-A polycarbonate block copolymer (Bayer AG) (1.742 g/m$^2$), Lexan 141-112® bisphenol-A polycarbonate (General Electric Co.) (1.426 g/m$^2$), Fluorad FC-431® perfluorinated alkylsulfonamidoalkyl ester surfactant (3M Co.) (0.11 g/m$^2$), and Drapex 429® polyester plasticizer (Witco Corp.) (0.264 g/m$^2$), and diphenyl phthalate (0.528 g/m$^2$) coated from methylene chloride.

The dye-receiving layer was then overcoated with a solvent mixture of methylene chloride and trichloroethylene; a polycarbonate random terpolymer of bisphenol-A (50 mole-%), diethylene glycol (49 mole-%), and polydimethylsiloxane (1 mole-%) (2,500 MW) block units (0.550 g/m$^2$); a bisphenol A polycarbonate modified with 50 mole-% diethylene glycol (2,000 MW) (0.11 g/m$^2$); Fluorad FC-431® surfactant (0.022 g/m$^2$); and DC-510 surfactant (Dow Corning Corp.) (0.003 g/m$^2$).

Preparation of Inorganic Salt-Containing Dye-Receiver Elements (E-1 to E-3 and C-2 to C-18)

Lithium chloride (LiCl), (E-1), magnesium chloride ($MgCl_2.6H_2O$) (E-2), and aluminum chloride ($AlCl_3.6H_2O$) (E-3) were added to the above control subbing layer (SL) solution in accordance with the invention. Control elements (C-2 through C-18) were prepared by adding various salts to the dye-receiving layer (DRL) solution, and receiver overcoat (ROC) solution, and backcoat (BC) solution in one or several layers of the receiver element. Detailed compositions of salts in separate layer (e.g., SL, DRL, ROC or BC) or adjacent layer combination (e.g., ROC/DRL, ROC/DRL/SL) in terms of dry laydown (g/m$^2$) are summarized in Table 1.

Preparation of Thermal Transfer Images and Measurement of Printing-Induced Surface Charge The resultant multilayer dye-receiver elements were then subjected to thermal printing and image-side surface charge measurements. In order to compare the examples and controls for charge generation, a 0.25 density yellow flat field image was printed on all of the samples using a Kodak XLS 8600® Thermal Printer and Kodak EKTATHERM® V1.5 donor ribbon. The 20.3 cm×22.7 cm yellow flat field images were printed on receiver samples cut to 21.7 cm×30.7 cm. Surface voltage (charge) measurements were made using a TREK® voltmeter (Model 344). Measurements were made at three points on the image (middle of the lead edge, image center, and middle of the trailing edge) and these values were averaged together. The samples were conditioned and printed at 85% RH/23° C. The following results were obtained:

TABLE 1

| Sample ID | Salt in SL ($g/m^2$) | Salt in DRL ($g/m^2$) | Salt in ROC ($g/m^2$) | Salt in ROC/ DRL ($g/m^2$) | Salt in ROC/ DRL/SL ($g/m^2$) | Salt in BC ($g/m^2$) | Surface Voltage @ 85% RH Printing (volts) |
|---|---|---|---|---|---|---|---|
| E-1 | LiCl (0.0033) | — | — | — | — | — | 4 |
| E-2 | $MgCl_2 . 6H_2O$ (0.0154) | — | — | — | — | — | 35 |
| E-3 | $AlCl_3 . 6H_2O$ (0.0172) | — — | — | — | — | — | 3 |
| C-1 (Control) | — | — | — | — | — | — | 148 |
| C-2 (Control) | — | LiCl (0.0033) | — | — | — | — | 154 |
| C-3 (Control) | | LiCl (0.1188) | — | — | — | — | 61 |
| C-4 (Control) | | $MgCl_2 . 6H_2O$ (0.0154) | — | — | — | — | 133 |
| C-5 (Control) | — | $MgCl_2 . 6H_2O$ (0.5544) | — | — | — | — | 131 |
| C-6 (Control) | — | $AlCl_3 . 6H_2O$ (0.0187) | — | — | — | — | 189 |
| C-7 (Control) | — | $AlCl_3 \cdot 6H_2O$ (0.6732) | — | — | — | — | 71 |
| C-8 (Control) | — | — | LiCl (0.0033) | — | — | — | 186 |
| C-9 (Control) | — | — | LiCl (0.0198) | — | — | — | 146 |
| C-10 (Control) | — | — | $MgCl_2 . 6H_2O$ (0.0154) | — | — | — | 186 |
| C-11 (Control) | — | — | $MgCl_2 . 6H_2O$ (0.0924) | — | — | 168 | |
| C-12 (Control) | — | — | $AlCl_3 . 6H_2O$ (0.0187) | — | — | — | 235 |
| C-13 (Control) | — | — | $AlCl_3 . 6H_2O$ (0.1122) | — | — | — | 157 |
| C-14 (Control) | — | — | — | LiCl (0.0017)/ LiCl (0.0017) | — | — | 138 |
| C-15 (Control) | — | — | — | LiCl (0.0011) LiCl (0.0011) LiCl (0.0011) | — | 83 | |
| C-16 (Control) | — | — | — | — | — (0.0033) | LiCl | 550 |
| C-17 (Control) | — | — | — | — | — $6H_2O$ (0.0154) | $MgCl_2 .$ | 619 |
| C-18 (Control) | — | — | — | — | $AlCl_3 . 6H_2O$ 0.0187 | 129 | |

SL = subbing layer
DRL = dye-receiving layer
ROC = receiver overcoat
BC = backing coat The above results show that the addition of an inorganic salt to the subbing layer in accordance with the invention is more effective than adding the same material to the element in other locations (E-1 vs. C-2, C-3, C-8, C-9, C-14, and C-15) (E-2 vs. C-4, C-5, C-10, and C-11) (E-3 vs. C-6, C-7, C-12, and C-13).

In comparison to the C-1 control which has no inorganic salt added, the use of a salt in the antistat backcoat is ineffective or worse for charge reduction.

EXAMPLE 2

Preparation of the Microvoided Support

The receiver support used in this example is the same as Example 1 but did not have a BICOR® 70 MLT film on its backside. The backside was coated with clear, high density polyethylene (30 g/m$^2$) instead. On top of this layer an antistat backing coat was coated from a water and isobutyl alcohol solvent mixture. The backing coat contained the following ingredients: poly(vinyl alcohol) (0.165 g/m$^2$); LUDOX AM® alumina modified colloidal silica of approximately 0.014 $\mu$m (DuPont) (0.539 g/m$^2$); polystyrene beads crosslinked with m- and p-divinylbenzene of average diameter of 4 $\mu$m (0.275 g/m$^2$); Polyox WSRN-10® polyethylene oxide (0.066 g/m$^2$); Glucopan® 225 surfactant (0.033 g/m$^2$); and Triton X200E® surfactant (Rohm and Haas) (0.022 g/m$^2$).

Preparation of Control Dye-Receiver Elements (C-19)

The preparation of dye-receiving layer and receiver overcoat, and receiver support was the same as that of C-1 in Example 1.

Preparation of Inorganic Salt-Containing Dye-Receiver Elements (E-4)

Subbing layer coating solutions were prepared by mixing Prosil 221® (0.055 g/m$^2$) with Prosil 2210® (0.055 g/m$^2$), along with LiCl (0.0033 g/m$^2$). This solution contained approximately 1% of silane component, 1% water and 98% of 3A alcohol.

The preparation of dye-receiving layer and receiver overcoat, and receiver support is the same as C-1 in Example 1. The following results were obtained:

TABLE 2

| Sample ID | Salt in Subbing Layer (g/m$^2$) | Surface Voltage @ 85% RH Printing (volts) |
|---|---|---|
| E-4 | LiCl (0.0033) | 6 |
| C-19 (Control) | none | 519 |

The above results show that the control receiver element having an antistat backcoat had a higher surface charge (519 volts) on the imaged-side surface than one without an antistat backcoat (148 volts, C-1, Table 1). The element of the invention containing lithium chloride in the subbing layer reduces the surface charge dramatically (E-4 vs. C-19).

EXAMPLE 3

U.S. Pat. No. 5,585,326 incorporated ionic dyes, such as Benzo Black A250®, along with other ingredients into the subbing layer to adjust the background colorimetry of the receiver element to meet the requirements for pre-press color proofing purposes. The structures of these dyes are as follows:

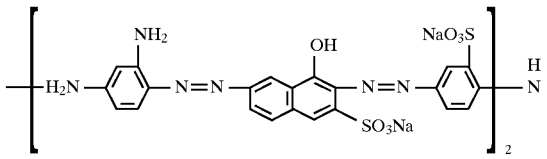

Benzo Black A250®

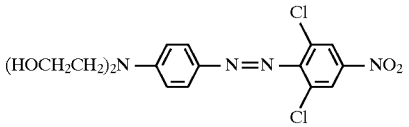

Eastone Brown 2R®

Subbing layer coating solutions were prepared by mixing Prosil 221® (0.055 g/m$^2$) with Prosil 2210® (0.055 g/m$^2$), along with Benzo Black A250® black dye and Eastone Brown 2R® brown dye in the amounts as shown in Table 3. Each solution contained approximately 1% of silane component, and either 20% water and 79% of 3A alcohol, or 1% water and 98% of 3A alcohol.

The preparation of the dye-receiving layer, receiver overcoat, and receiver support is the same as that of C-1 in Example 1. The following results were obtained:

TABLE 3

| Sample ID | Benzo Black A250 ® in Subbing Layer (g/m$^2$) | Eastone Brown 2R ® in Subbing Layer (g/m$^2$) | Salt in Subbing Layer (g/m$^2$) | % water in Subbing Layer | Surface Voltage @ 85% RH Printing (volts) |
|---|---|---|---|---|---|
| E-5 | none | none | LiCl (0.0033) | 1 | 4 |
| C-20 (Control) | 0.0044 | 0.0009 | none | 20 | 248 |
| C-21 (Control) | 0.0077 | 0.0015 | none | 20 | 252 |
| C-22 (Control) | 0.0462 | 0.0992 | none | 20 | 185 |
| C-23 (Control) | 0.0462 | 0.0092 | none | 1 | 222 |
| C-24 (Control) | 0.0077 | 0.0015 | none | 1 | 246 |
| C-25 (Control) | 0.0044 | 0.0009 | none | 1 | 258 |

The above results show that an inorganic salt-containing subbing layer can reduce the surface charge very effectively, while the ionic dye-containing subbing layer of the control as disclosed in U.S. Pat. No. 5,585,326 is not capable of bringing the surface charge down to an appropriate level.

EXAMPLE 4

Subbing layer coating solutions were prepared by mixing Prosil 221® (0.055 g/m$^2$) with Prosil 2210® (0.055 g/m$^2$), along with inorganic monovalent salts LiCl, LiI, NaCl, KCl, RbCl, and CsCl, divalent salts $Mg(NO_3)_2.6H_2O$, $MgCl_2.6H_2O$, $Ca(NO_3)_2.4H_2O$ and $Zn(NO_3)_2.6H_2O$, and trivalent salts $AlCl_3.6H_2O$, $Al(NO_3)_3.9H_2O$ in the amounts of equal molar concentration as shown in Table 4. Each solution contained approximately 1% of silane component, and either 20% water and 79% of 3A alcohol, or 1% water and 98% of 3A alcohol.

The preparation of dye-receiving layer and receiver overcoat, and receiver support is the same as that of C-1 in Example 1. The following results were obtained:

TABLE 4

| Sample ID | Mono-valent Salt in Subbing Layer ($g/m^2$) | Divalent Salt in Subbing Layer ($g/m^2$) | Tri-valent Salt in Subbing Layer ($g/m^2$) | % water in Subbing Layer | Surface Voltage @ 85% RH Printing (volts) |
|---|---|---|---|---|---|
| E-6 | LiCl (0.0033) | — | — | 1 | 6 |
| E-7 | LiCl (0.0105) | — | — | 1 | 9 |
| E-8 | NaCl (0.0045) | — | — | 1 | 105 |
| E-9 | Kcl (0.0058) | — | — | 1 | 150 |
| E-10 | RbCl (0.0095) | — | — | 1 | 154 |
| D-11 | CsCl (0.0132) | — | — | 1 | 41 |
| E-12 | — | $MgNO_3)_2.6H_2O$ (0.0187) | — | 20 | 14 |
| E-13 | — | $Ca(NO_3)_2.4H_2O$ (0.0176) | — | 20 | 39 |
| E-14 | — | $Zn(NO_3)_2.6H_2O$ (0.0220) | — | 20 | 196 |
| E-15 | — | $MgCl_2.6H_2O$ (0.0154) | — | 1 | 35 |
| E-16 | — | — | $Al(NO_3)_3.9H_2O$ (0.0275) | 20 | 25 |
| E-3 | — | — | $AlCl_3.6H_2O$ (0.0176) | 1 | 3 |
| C-26 (Control) | — | — | — | 1 | 293 |

The above results show that inorganic salts are capable of bringing the surface charge down very effectively as compared to the control receiver element (C-26).

EXAMPLE 5

Subbing layer coating solutions were prepared by mixing Prosil 221® (0.055 $g/m^2$) with Prosil 2210® (0.055 $g/m^2$), along with LiCl in the amounts as shown in Table 5. Each solution contained approximately 1% of silane component, and either 20% water and 79% of 3A alcohol, or 1% water and 98% of 3A alcohol.

The preparation of dye-receiving layer and receiver overcoat, and receiver support is the same as C-1 in Example 1. The following results were obtained:

TABLE 5

| Sample ID | Salt in Subbing Layer ($g/m^2$) | % water in Subbing Layer | Surface Voltage @ 85% RH Printing (volts) |
|---|---|---|---|
| E-17 | LiCl (0.0011) | 1 | 67 |
| E-18 | LiCl (0.0022) | 1 | 19 |
| E-6 | LiCl (0.0033) | 1 | 6 |
| E-19 | LiCl (0.0066) | 1 | 7 |
| C-26 (Control) | none | 1 | 293 |
| E-20 | LiCl (0.0033) | 20 | 3 |
| E-21 | LiCl (0.0066) | 20 | 7 |
| E-22 | LiCl (0.0099) | 20 | 2 |
| E-23 | LiCl (0.0132) | 20 | 2 |

TABLE 5-continued

| Sample ID | Salt in Subbing Layer ($g/m^2$) | % water in Subbing Layer | Surface Voltage @ 85% RH Printing (volts) |
|---|---|---|---|
| C-27 (Control) | none | 20 | 222 |

The above results show that the subbing layer of the invention containing an inorganic salt in various amounts and in subbing layers with different amounts of water were better than the control elements which did not contain any inorganic salt.

The invention has been described in detail with particular reference to preferred embodiments thereof, but it will be understood that variations and modifications can be effected within the spirit and scope of the invention.

What is claimed is:

1. A dye-receiving element comprising a support having thereon, in order, a subbing layer and a dye image-receiving layer containing a thermally-transferred dye image, wherein said subbing layer contains an iono-conductive material.

2. The element of claim 1 wherein said iono-conductive material is an inorganic salt.

3. The element of claim 2 wherein said inorganic salt is LiCl, LiI, NaCl, $KNO_3$, RbCl, CsCl, $MgCl_2.6H_2O$, $Mg(NO_3)_2.6H_2O$, $Ca(NO_3)_2.4H_2O$, $Zn(NO_3)_2.6H_2O$, $AlCl_3.6H_2O$, $Al(NO_3)_3.9H_2O$ or $Ce(NO_3)_3.6H_2O$.

4. The element of claim 1 wherein said iono-conductive material is present in an amount of from about 0.001 $g/m^2$ to about 1 $g/m^2$.

5. The element of claim 1 wherein said subbing layer further comprises a reaction product of a mixture of a) an aminofunctional organo-oxysilane, and b) a hydrophobic organo-oxysilane.

6. The element of claim 5 wherein said aminofunctional organo-oxysilane has the following formula:

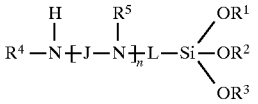

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as —$CH_2$—, —$CH(CH_3)$—, —$C_6H_4$— or combinations thereof; and n is 0 or a positive integer up to 6.

7. The element of claim 1 wherein said support is paper having a polyolefin film laminated thereto.

8. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye-receiving element comprises a support having thereon, in order, a subbing layer and a dye image-receiving layer, wherein said subbing layer contains an iono-conductive material.

9. The process of claim 8 wherein said iono-conductive material is an inorganic salt.

10. The process of claim 9 wherein said inorganic salt is LiCl, LiI, NaCl, $KNO_3$, RbCl, CsCl, $MgCl_2.6H_2O$, $Mg(NO_3)_2.6H_2O$, $Ca(NO_3)_2.4H_2O$, $Zn(NO_3)_2.6H_2O$, $AlCl_3.6H_2O$, $Al(NO_3)_3.9H_2O$ or $Ce(NO_3)_3.6H_2O$.

11. The process of claim 8 wherein said iono-conductive material is present in an amount of from about 0.001 $g/m^2$ to about 1 $g/m^2$.

12. The process of claim 8 wherein said subbing layer further comprises a reaction product of a mixture of a) an aminofunctional organo-oxysilane, and b) a hydrophobic organo-oxysilane.

13. The process of claim 12 wherein said aminofunctional organo-oxysilane has the following formula:

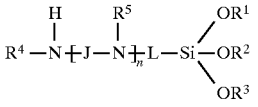

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as —$CH_2$—, —$CH(CH_3)$—, —$C_6H_4$— or combinations thereof; and n is 0 or a positive integer up to 6.

14. The process of claim 8 wherein said support is paper having a polyolefin film laminated thereto.

15. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises a support having thereon, in order, a subbing layer and a dye image-receiving layer, wherein said subbing layer contains an iono-conductive material.

16. The assemblage of claim 15 wherein said iono-conductive material is an inorganic salt.

17. The assemblage of claim 16 wherein said inorganic salt is LiCl, LiI, NaCl, $KNO_3$, RbCl, CsCl, $MgCl_2.6H_2O$, $Mg(NO_3)_2.6H_2O$, $Ca(NO_3)_2.4H_2O$, $Zn(NO_3)_2.6H_2O$, $AlCl_3.6H_2O$, $Al(NO_3)_3.9H_2O$ or $Ce(NO_3)_3.6H_2O$.

18. The assemblage of claim 15 wherein said iono-conductive material is present in an amount of from about 0.001 $g/m^2$ to about 1 $g/m^2$.

19. The assemblage of claim 15 wherein said subbing layer further comprises a reaction product of a mixture of a) an aminofunctional organo-oxysilane, and b) a hydrophobic organo-oxysilane.

20. The assemblage of claim 19 wherein said aminofunctional organo-oxysilane has the following formula:

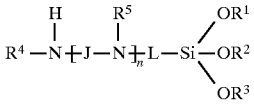

wherein $R^1$, $R^2$ and $R^3$ each independently represents a substituted or unsubstituted alkyl group having from one to about 10 carbon atoms, a substituted or unsubstituted aryl group having from about 5 to about 10 carbon atoms, or a substituted or unsubstituted carbocyclic group having from about 5 to about 10 carbon atoms;

$R^4$ and $R^5$ each independently represents hydrogen or the same groups as $R^1$, $R^2$ and $R^3$;

J and L each independently represents hydrocarbon linking moieties of from 1 to about 12 carbon atoms, such as —$CH_2$—, —$CH(CH_3)$—, —$C_6H_4$— or combinations thereof; and n is 0 or a positive integer up to 6.

* * * * *

UNITED STATES PATENT AND TRADEMARK OFFICE

CERTIFICATE OF CORRECTION

PATENT NO. : 5,858,916
DATED : January 12, 1999
INVENTOR(S) : Teh-Ming Kung, et al It is certified that error appears in the above-identified patent and that said Letters Patent is hereby corrected as shown below:

On title page, item [75] should read as follows:

[75] -- Teh-Ming Kung, Rochester, Kin K. Lum, Webster, Bruce C. Campbell, Rochester, Thomas W. Martin, Rochester, --

Signed and Sealed this

Tenth Day of August, 1999

*Attest:*

Q. TODD DICKINSON

*Attesting Officer*

*Acting Commissioner of Patents and Trademarks*